US007494363B1

(12) United States Patent
Wu

(10) Patent No.: US 7,494,363 B1
(45) Date of Patent: Feb. 24, 2009

(54) PLUG CONNECTOR HAVING A LATCHING MECHANISM

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/215,579

(22) Filed: Jun. 27, 2008

(51) Int. Cl.
*H01R 13/62* (2006.01)

(52) U.S. Cl. ..... 439/352

(58) Field of Classification Search ..... 439/352, 439/357, 358, 953
See application file for complete search history.

(56) References Cited

U.S. PATENT DOCUMENTS 5,564,939 A 10/1996 Maitani et al.
5,797,771 A 8/1998 Garside
6,165,006 A 12/2000 Yeh et al.
6,648,665 B1 11/2003 Wu
6,659,790 B1 12/2003 Wu
6,749,458 B1 6/2004 Kuo et al.
6,866,533 B2 3/2005 Wu
6,887,091 B1 5/2005 Wu
6,887,101 B2 5/2005 Ito et al.
7,014,491 B1 * 3/2006 Simmel ..... 439/353

* cited by examiner

*Primary Examiner*—Tho D Ta
(74) *Attorney, Agent, or Firm*—Wei Te Chung

(57) ABSTRACT

A plug connector (100) mating with a complementary connector includes a housing (1) having a base (11) defining a first slot and a second slot (1111), a latching mechanism (40) having a pusher (3) and a latch (2). The pusher includes a resilient beam (31) disposed in the first slot and facing toward the second slot, and a resisting portion (340). The latch has a latching portion (22) and an inclined connecting portion (23) engageable with the resisting portion. The resilient beam of the pusher is downwardly deformable in the second slot from an initial position to a final position to move the resisting portion relative to the connecting portion, to thereby move the latching portion from a latching position to an unlatching position.

14 Claims, 6 Drawing Sheets

PLUG CONNECTOR HAVING A LATCHING MECHANISM

CROSS-REFERENCE TO RELATED APPLICATIONS

This patent application is related to a pending U.S. patent application entitled "PLUG CONNECTOR HAVING A LATCHING MECHANISM", which is invented by the same inventor as this patent application and assigned to the same assignee with this application.

BACKGROUND OF THE INVENTION

1. Field of the Invention

The present invention generally relates to a cable end connector, and more particularly to a plug connector used for high-speed signal transmission.

2. Description of Related Art

A committee called SFF is an ad hoc group formed to address storage industry needs in a prompt manner. When formed in 1990, the original goals were limited to define de facto mechanical envelopes within disk drives can be developed to fit compact computer and other small products.

Specification SFF-8088 defines matable Compact Multilane Shielded connectors adopted for being used in laptop portable computer to connect small-size disk drives to a circuit board. The connectors comprise a plug connector connecting with the small-size drive and a header mounted on the circuit board. The plug connector defined in the specification comprises a pair of engagable metal housings together defining a receiving space therebetween, a circuit board received in the receiving space, a cable comprising a plurality of conductors electrically connecting with the circuit board, and a latching mechanism assembled to a top surface of the upper metal housing. The latching mechanism comprises an elongated T-shape latch member for latching with the header mentioned above and an actuating member cooperating with the latch member for actuating the latch member to separate from the header. The latch member is assembled to a rear portion of a base of the upper housing with latch portion exposed beyond a front portion of the base of the upper housing to locate above a tongue portion of the upper housing.

However, such elongated latch member is hard to be actuated by the actuating member, otherwise the latch member must have enough thickness or made by high-quality material having enough rigidity to achieve the goal of latching reliably and unlatching easily.

Hence, an improved plug connector is provided in the present invention to address the problems mentioned above and meet the current trend.

BRIEF SUMMARY OF THE INVENTION

Accordingly, an object of the present invention is to provide a plug connector having a latching mechanism for achieving a reliable latching and an easy unlatching.

In order to achieve the above-mentioned object, a plug connector mating with a complementary connector in accordance with the present invention includes a housing, a circuit board, a latching mechanism and a metal shell. The housing includes a base defining a first and a second slots, and a tongue portion extending forwardly from the base for fitting with the complementary connector. The latching mechanism includes a pusher and a latch. The pusher includes a resilient beam disposed in the first slot and facing toward the second slot, a head portion connected with the resilient beam and provided with a resisting portion, and a depressing portion formed above the resilient beam. The latch has an inclined connecting portion engageable with the resisting portion and a latching portion. The metal shell is attached to the base and has a window for outward passage of the pressing portion. The resilient beam of the pusher is downwardly deformable in the second slot from an initial position to a final position to move the resisting portion relative to the inclined connecting portion of the latch, to thereby move the latching portion from a latching position to an unlatching position.

The latching mechanism comprises a pusher and a latch cooperated with each other to latch or unlatch the complementary connector. When the pusher is depressed, the latch would be driven from the latching position to the unlatching position automatically. When the pusher is released, the pusher would restore to the initial position automatically. It is easy to drive the whole latching mechanism to perform the latching and unlatching function, if only depressing the pusher or releasing the pusher. Additionally, the claws would latch the complementary connector reliably, since the latch restores itself to the latching position via a resilient restoring force provided by the resilient beam of the pusher.

Other objects, advantages and novel features of the invention will become more apparent from the following detailed description of the present embodiment when taken in conjunction with the accompanying drawings.

DETAILED DESCRIPTION OF THE INVENTION

Figure 1:
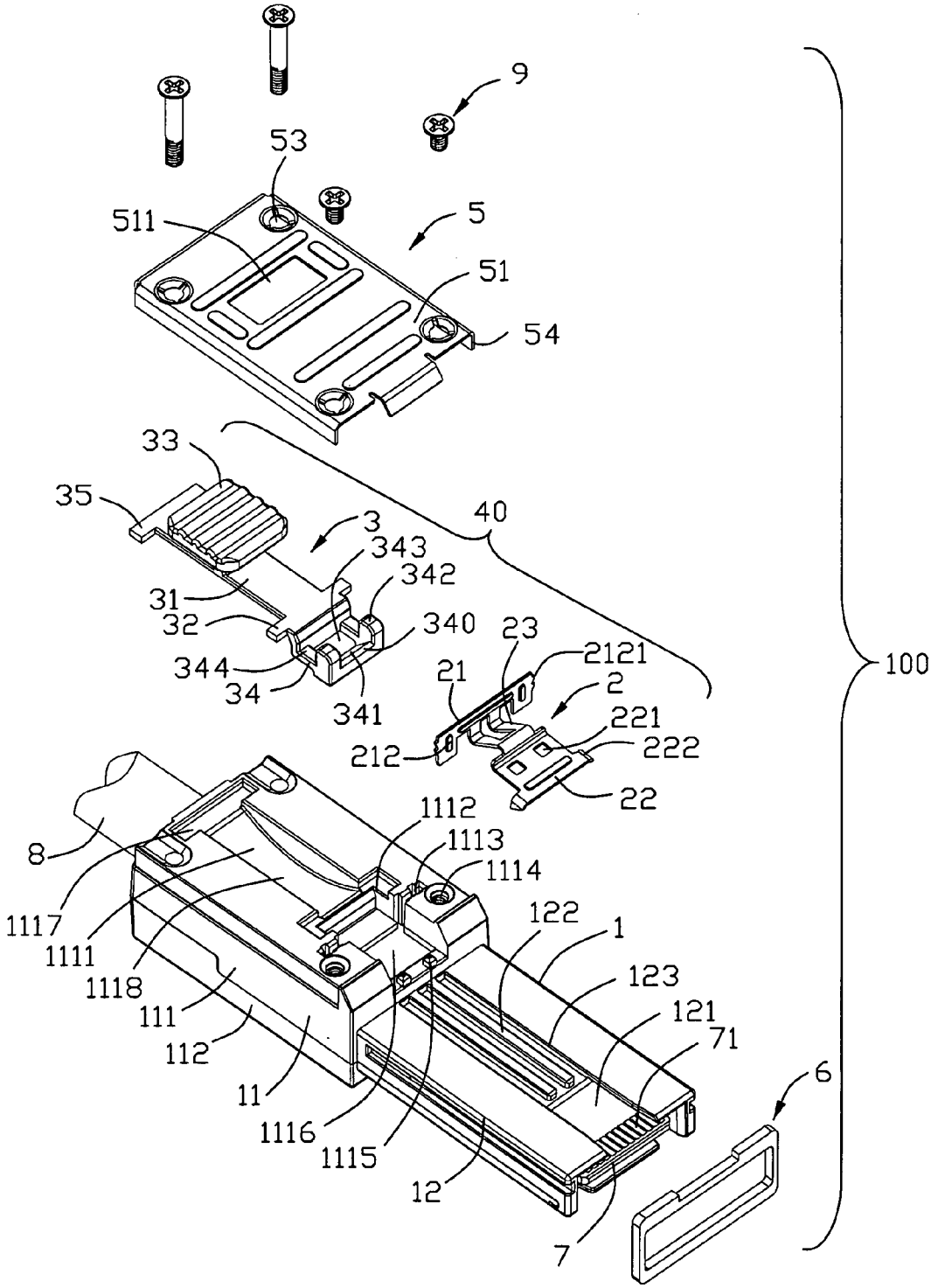
FIG. 1 is an exploded view of a plug connector in accordance with the present invention.

Reference will now be made to the drawing figures to describe the present invention in detail.

Figure 2:
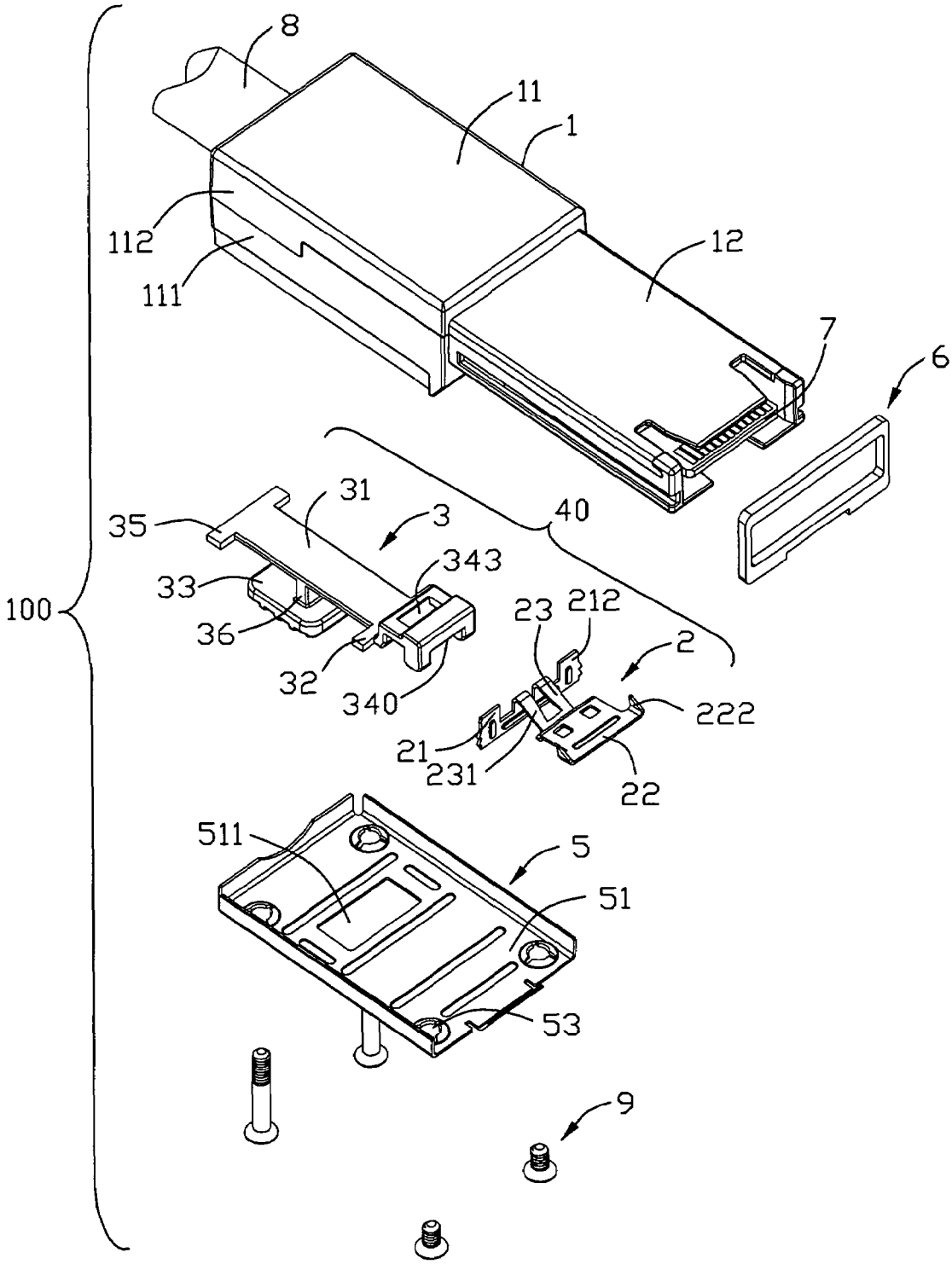
FIG. 2 is a view similar to FIG. 1, taken from another aspect.
Figure 3:
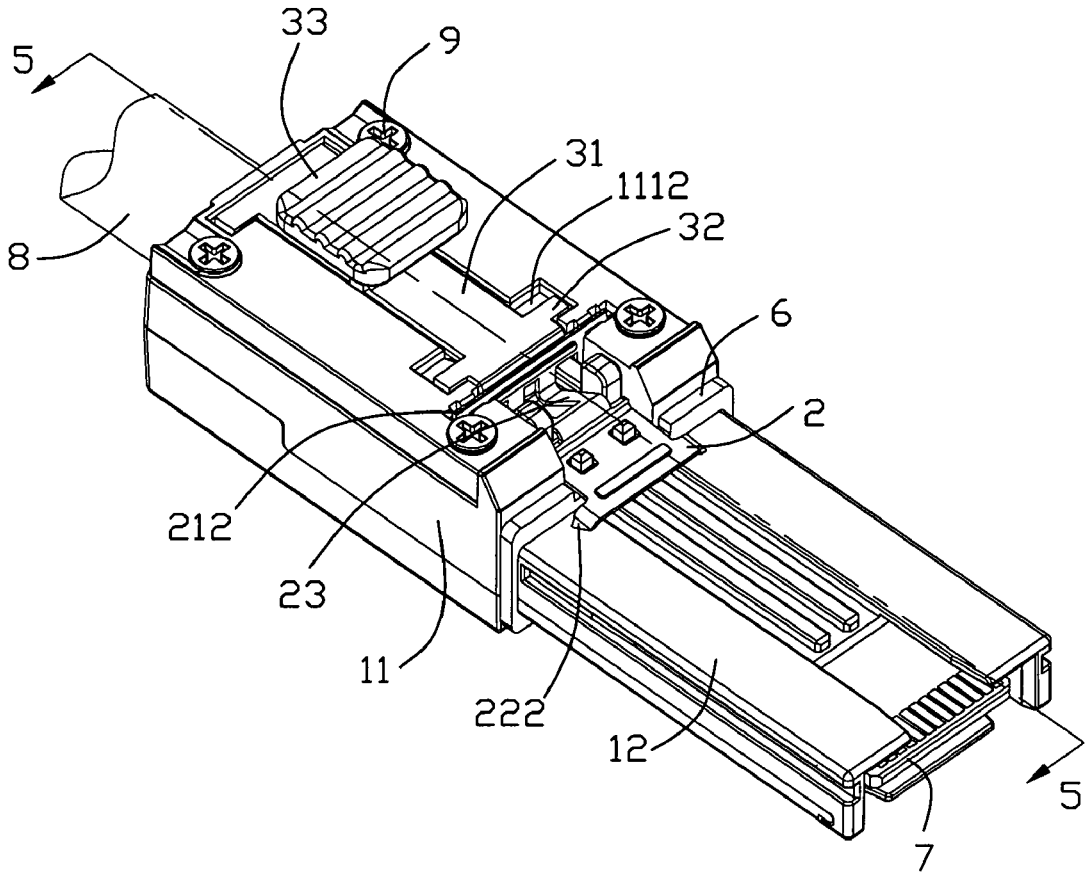
FIG. 3 is a partially assembled perspective view of the plug connector as shown in FIG. 1, with the metal shell being removed.

Referring to FIGS. 1-3, a plug connector 100 mating with a complimentary connector (not shown) in accordance with the present invention comprises a housing 1, a latching mechanism 40 assembled to the housing 1, an EMI gasket 6 attached to the housing 1, a metal shell 5 partially covering the latching mechanism 40, a plurality of screws 9 fixing the metal shell 5 on the housing 1, a circuit board 7 disposed in the housing 1, and a cable 8 electrically connected to the circuit board 7. Optionally, the cable 8 could be replaced by any other structure in accordance with customer's requires.

Referring to FIGS. 1-2, the housing 1 of the present invention comprises a base 11 and an elongated tongue portion 12 extending forwardly from the base 11. The base 11 comprises a lower base 112, an upper base 111 engaging with the lower base 112 and a receiving space (not shown) defined between the upper and lower bases 111, 112 for partially retaining the circuit board 7 and the cable 8 in a common manner. Both upper and lower bases 111 and 112 are preferably die-casted.

The upper base 111 defines an elongated receiving slot 1111 having an arc-like shaped lower surface 1118, a retaining recess 1116 concave from an upper surface of the upper base 111. The receiving slot 1111 is father away from the tongue portion 12, than the retaining recess 1116 is away from the tongue portion 12. The upper base 111 comprises a transversely extending engaging recess 1112, a receiving recess 1117 defined at a rear side of the upper base 111, an insertion recess 1113 communicating with the retaining recess 1116, four screw holes 1114 defined at four corners of the upper base 111, and a pair of protruding tabs 1115 formed at a front edge of the retaining recess 1116.

The circuit board 7 is formed with a plurality of conductive pads 71 for electrically connecting with the complementary connector. The tongue portion 12 has a receiving space (not labeled) defined therein for receiving a front portion of the circuit board 7, and an opening 121 defined on an upper surface thereof for exposing the conductive pads 71 of the circuit board 7. The tongue portion 12 has a plurality of flanges 122 formed on an upper surface thereof and a plurality of keyways 123 each defined adjacent to one flange 122.

The latching mechanism 40 comprises a latch 2 and a pusher 3 assembled to the latch 2. The latch 2 made of metal material is a cantilever-type member. The latch 2 comprises a transverse bar section 21 located in a vertical surface, a flat latching portion 22 located in a horizontal surface perpendicular to the vertical surface and an inclined connecting portion 23 connecting the bar section 21 and the latching portion 22 to provide resilient force to the latch 2. The bar section 21 has a pair of side sections 212 extending downwardly from opposite sides thereof. Each side section 212 is formed with a plurality of barbs 2121 on outmost edge thereof. The flat latching portion 22 defines a pair of rectangular holes 221 adjacent to the connecting portion 23, and a pair of claws 222 bending downwardly from opposite sides of the front edge thereof for clasping the complementary connector. The connecting portion 23 also defines a slit (not labeled) therein for adjusting spring force of the latch 2 through changing size and shape of the hole.

The pusher 3 comprises a rectangular resilient beam 31 and a head portion 34 connected with the resilient beam 31. The resilient beam 31 comprises a ear portion 32 formed at a connecting portion of the resilient beam 31 and the head portion 34, a tail portion 35 formed at a free end of the resilient beam 31, a pressing portion 33 provided above the resilient beam 31, and a neck portion 36 upholding the pressing portion 33. The head portion 34 comprises a pair of symmetrically formed flanges 344, a pair of blocks 342 respectively formed at a front portion of the flange 344, a resisting portion 340 between the pair of blocks 342, and an indentation 343 defined between the flanges 344. The resisting portion 340 has an inclined face 341 inclining toward the indentation 343.

The metal shell 5 comprises a top wall 51, a pair of side walls 54 bending downwardly from the top wall 51. The top wall 51 has a window 511 and four mounting holes 53 defined at four corner portions thereof.

Referring to FIGS. 1-3, in assembly of the plug connector 100, the cable 8 is soldered to the circuit board 7. The circuit board 7 together with the cable 8 is partially sandwiched between the upper and lower bases 111, 112. The pusher 3 is assembled to the upper base 111 of the housing 1, with the head portion 34 plunged in the retaining recess 1116. The body portion 31 of the pusher 3 is disposed above the receiving slot 1111, with the ear portion 32 attached to a front edge of the engaging recess 1112 and slidable in the engaging recess 1112, and the tail portion 35 fixed in the receiving recess 1117. The engaging recess 1112 and receiving recess 1117 could be regarded as a slot for receiving the ear portion 32 and the tail portion 35. The latch 2 is inserted in the retaining recess 1116, with the connecting portion 23 plunged in the indentation 343 of the pusher 3. In conjunction with FIG. 5, the resisting portion 340 contact with the connecting portion 23 to support the connecting portion 23 of the latch 2. The side sections 212 are inserted in the insertion recess 1113, with the barbs 2121 engaging with the insertion recess 1113. Thus, the latch 2 is restricted from a front-to-back movement. The pair of rectangular holes 221 engage with the pair of protruding tabs 1115.

Figure 4:
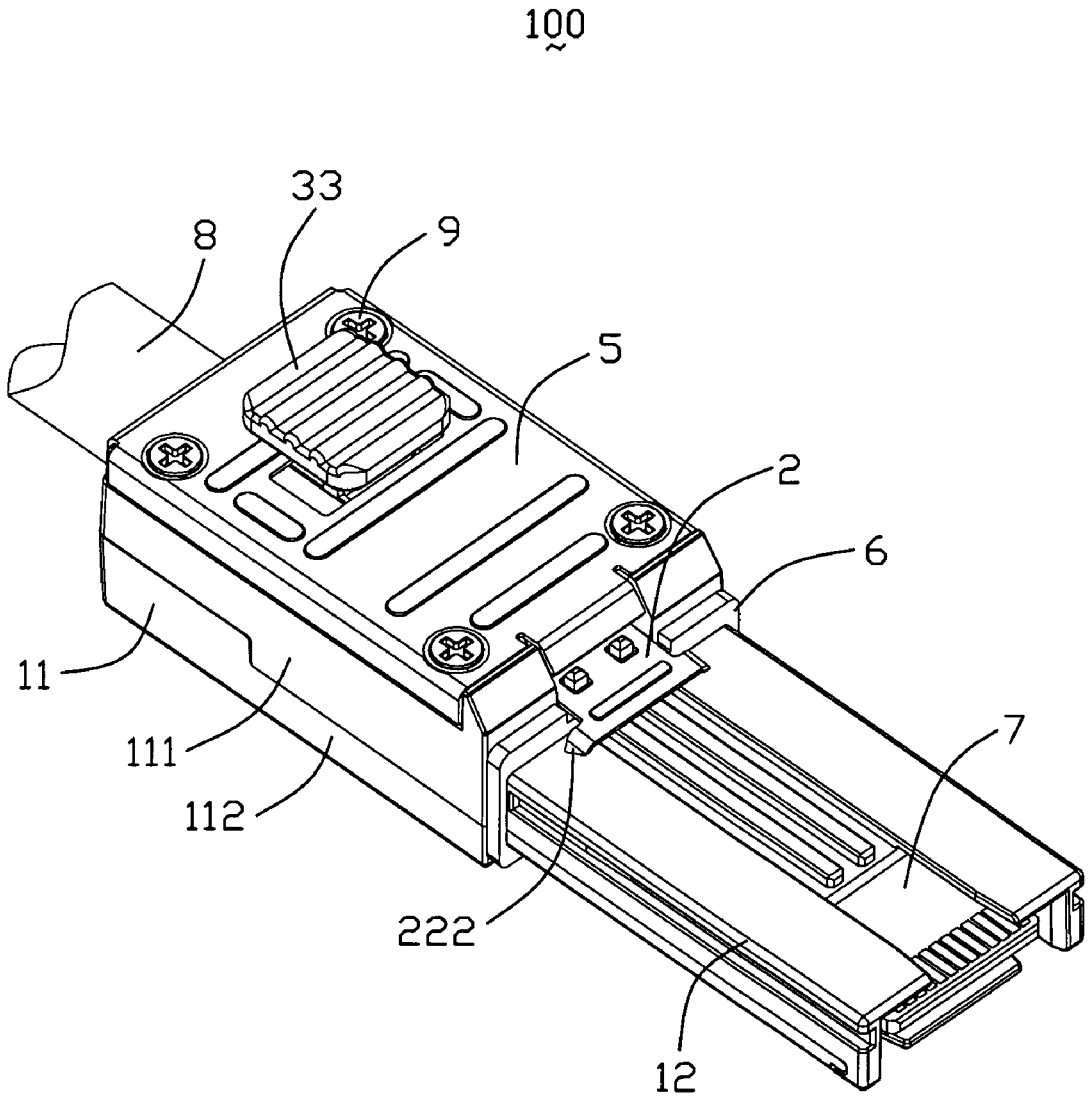
FIG. 4 is an assembled perspective view of the plug connector as shown in FIG. 1.
Figure 5:
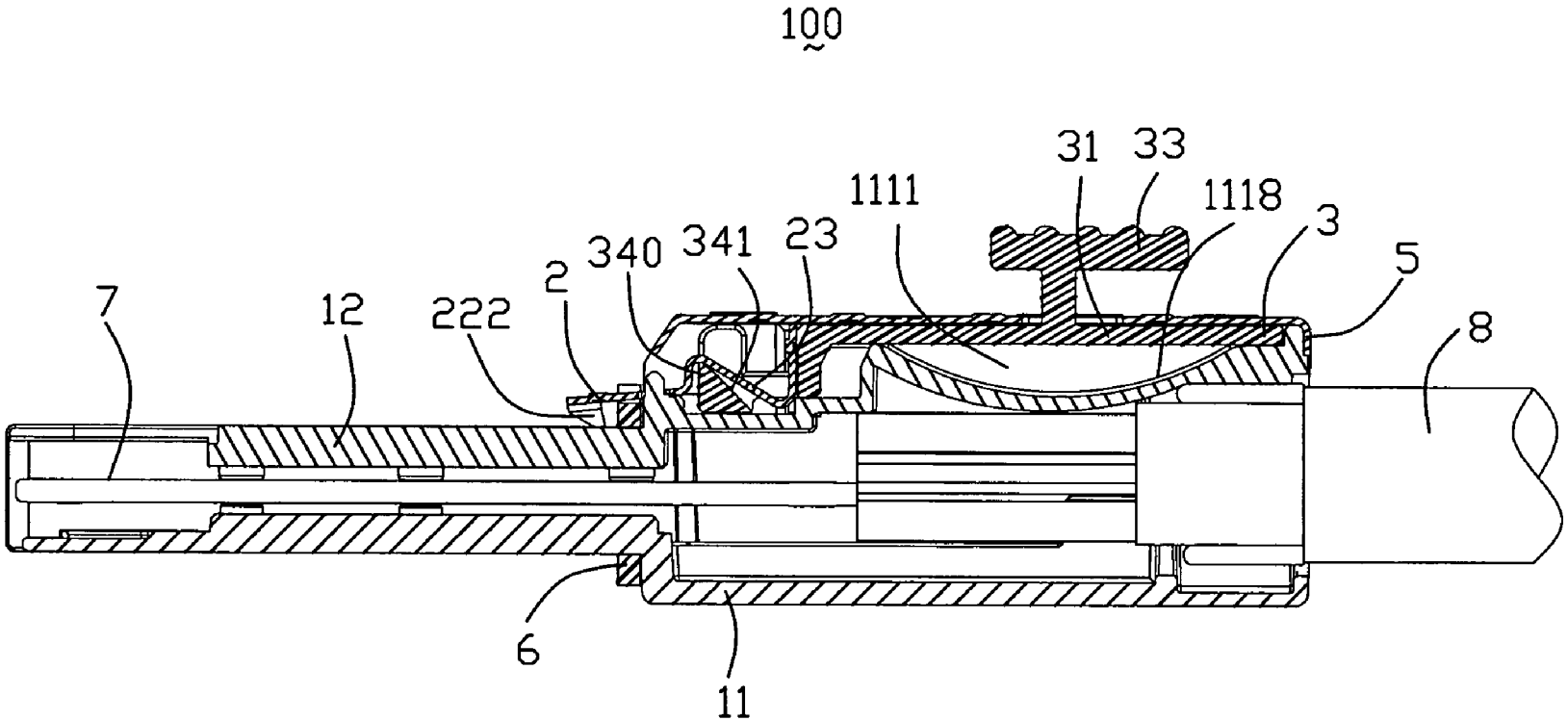
FIG. 5 is a cross-sectional view taken along line 5-5 of FIG. 4, when a latching mechanism is positioned in a latching position.

In conjunction with FIGS. 4 and 5, the EMI gasket 6 is attached to a front face of the base 11 of the housing 1 for shielding purpose. The metal shell 5 is fixed on the housing 1, with each screw 9 inserted through the mounting hole 53 into the screw hole 1114. The latching mechanism 40 is partially covered by the metal shell 5, with the pressing portion 33 extending outward the metal shell 5 through the window 511.

Figure 6:
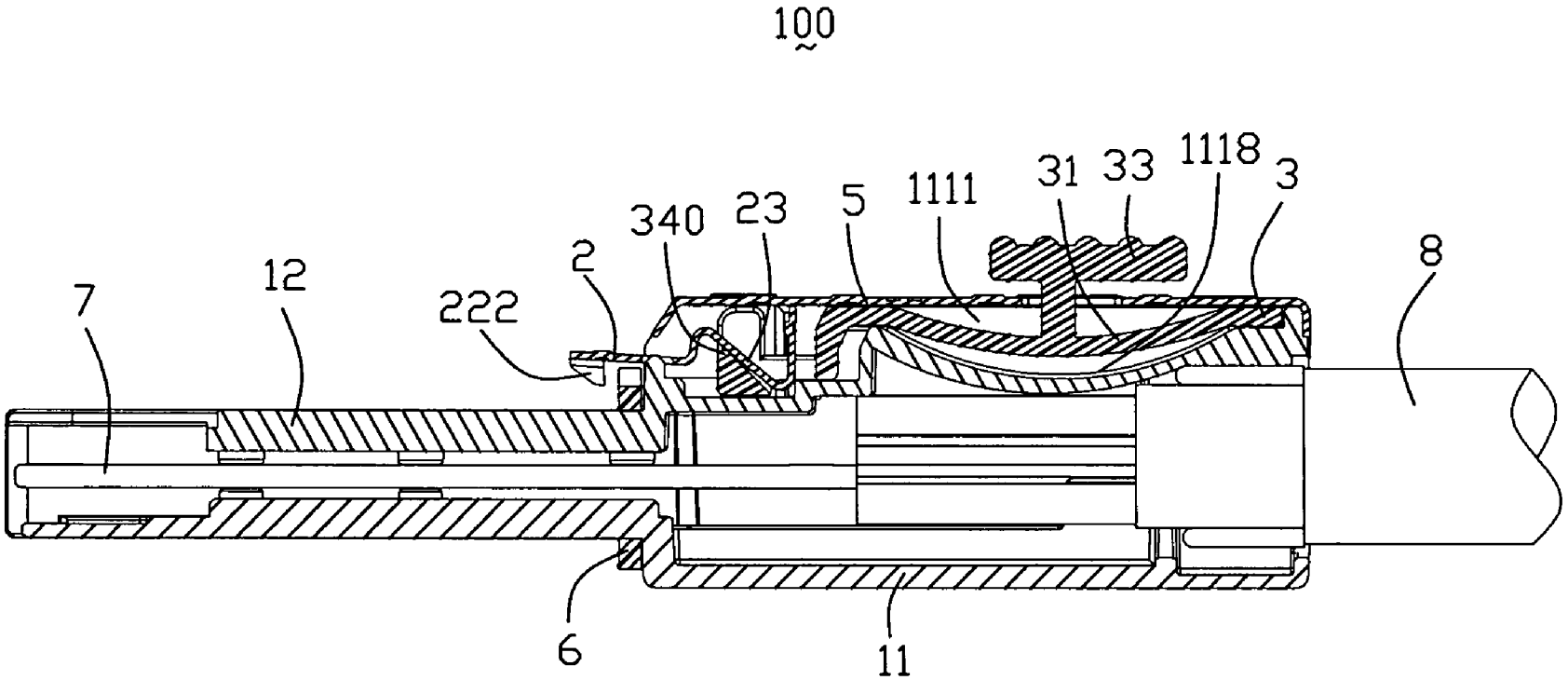
FIG. 6 is a view similar FIG. 5, showing the latching mechanism is positioned in an unlatching position.

FIG. 5 illustrates the plug connector 100 located in a latching position and FIG. 6 illustrates the plug connector 100 located in an unlatching position. When the pressing portion 33 of the pusher 3 is downwardly depressed from an initial position to a final position, the resilient beam 31 of the pusher 3 is deformable downwardly toward the arc-like lower surface 1118 in the receiving slot 1111. The head portion 34 retreats backwardly, with the resisting portion 340 sliding along the inclined connecting portion 23 of the latch 2 to move the connecting portion 23. Since the bar section 212 is restricted from the front-to-back movement by the insertion recess 1113, the connection portions 23 have been upheld by the resisting portion 340. In conjunction with FIG. 3, in such a process, the ear portion 32 of the pusher 3 slides backwardly and attached to a rear edge of the engaging recess 1112. At the same time, the latching portion 22 together with the claws 222 move upwardly to the released position.

When the plug connector 100 is located in the unlatching position as shown in FIG. 6, the complementary connector could be mounted onto or removed from the plug connector 100. When the pressing portion 33 of the pusher 3 is released, the resilient beam 31 of the pusher 3 would restore itself from the final position to the initial position. Simultaneously, the pressing portion 33 together with the whole latching mechanism 40 revert to the latching position as shown in FIG. 5. The complementary connector electrically connects with the conductive pads 71 of the circuit board 7, with claws 222 clasping corresponding structure of the complementary connector.

The latching mechanism 40 comprises a pusher 3 and a latch 2 cooperated with each other to latch or unlatch the complementary connector. When the pusher 3 is operated, the latch 2 would be driven from the latching position to the unlatching position automatically. When the pusher 3 is released, the pusher 3 would restore to the initial position automatically. It is easy to drive the whole latching mechanism 40 to perform the latching and unlatching function, if only depressing the pusher 3 or releasing the pusher 3. Additionally, the claws 222 would latch the complementary connector reliably, since the latch 2 restores itself to the latching position via the resilient restoring force provided by the resilient beam 31 of the pusher 3.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug connector adapted for mating with a complementary connector, comprising:

a housing comprising a base defining a first and a second slots, and a tongue portion extending forwardly from the base for fitting with the complementary connector;

a circuit board received in the housing;

a latching mechanism assembled to the base and comprising a pusher and a latch, said pusher having a resilient beam disposed in the first slot and facing toward the second slot, a head portion connected with the resilient beam and provided with a resisting portion, and a pressing portion formed above the resilient beam, said latch having an inclined connecting portion engageable with the resisting portion and a latching portion; and a metal shell attached to the base and having a window for outward passage of the pressing portion;

wherein said resilient beam of the pusher is downwardly deformable in the second slot from an initial position to a final position to move the resisting portion relative to the inclined connecting portion of the latch to thereby move the latching portion from a latching position to an unlatching position.

2. The plug connector as claimed in claim 1, further comprising an EMI gasket attached to a front side of the base.

3. The plug connector as claimed in claim 1, further comprising a cable electrically connected with the circuit board, and wherein said base has an upper base and a lower base sandwiching said circuit board.

4. The plug connector as claimed in claim 1, further comprising a plurality of screws, and wherein said base of the housing and the metal shell respectively define a plurality of mounting holes for insertion of the screws to fix the metal shell onto the housing.

5. The plug connector as claimed in claim 1, wherein said latching portion is provided with a pair of claws engagable with the complementary connector.

6. The plug connector as claimed in claim 1, wherein said resilient beam of the pusher is resiliently revertible from the final position to the initial position to revert the latching mechanism from the unlatching position to the latching position.

7. The plug connector as claimed in claim 6, wherein said pusher has a ear portion formed at a connecting portion between the resilient beam and the head portion, and a tail portion formed at a free end of the resilient beam, and said first slot comprises a receiving recess fixing the tail portion and an engaging recess moveably receiving the ear portion.

8. The plug connector as claimed in claim 6, wherein said second slot has an arc-like shaped lower surface corresponding to the deformed resilient beam of the pusher.

9. The plug connector as claimed in claim 6, wherein said base defines a retaining recess for retaining of the head portion of the pusher together with the connecting portion of the latch.

10. The plug connector as claimed in claim 9, wherein said latch comprises a bar section and a pair of side sections formed at opposite sides of the bar section, said housing defining a transversely extending insertion recess communicating with the retaining recess for insertion of the side sections to restrict the latch from a front-to-back movement.

11. The plug connector as claimed in claim 10, wherein said latching portion of the latch defines a pair of holes, said housing is formed with a pair of protruding tabs at a front edge of the retaining recess for engaging with the pair of holes of the latch.

12. The plug connector as claimed in claim 10, wherein said resisting portion of the pusher has an inclined face, the connecting portion of the latch comprising a pair of L-shaped connecting beams each having an obliquely extending lower surface facing toward the inclined face of the resisting portion.

13. The plug connector as claimed in claim 12, wherein said head portion of the pusher defines an indentation for positioning the connecting portion of the latch, said inclined face extending from the resisting portion toward the indentation.

14. A cable connector comprising:

a housing comprising a base and a mating port extending forwardly from the base for fitting with the complementary connector;

a latch positioned upon the base and having a hook at a front end and being deflectable in a vertical direction;

a deflectable pusher positioned upon the base and having a front engagement section engaged with the latch, said pusher including a rear pressing portion;

a shell covering a top face of the base to sandwich the pusher and the latch therebetween; and upon downwardly pressing the rear pressing portion, the pusher including the front engagement section is forcibly moved rearwardly, and rearward movement of the front engagement section results in upward deflection of the latch including the front hook;

wherein said shell functions as the stopper to only allow the pusher to move rearwardly.

* * * * *